United States Patent [19]

Miura

[11] Patent Number: 4,621,598

[45] **Date of Patent: * Nov. 11, 1986**

[54] HYDRAULIC LASH ADJUSTOR IN A VALVE OPERATING MECHANISM

[75] Inventor: Seishi Miura, Shiki, Japan

[73] Assignees: Nittan Valve Co., Ltd.; Honda Giken Kogyo Kabushiki Kaiska, both of Tokyo, Japan .

[ * ] Notice: The portion of the term of this patent subsequent to Jul. 23, 2002 has been disclaimed.

[21] Appl. No.: 526,452

[22] Filed: Aug. 25, 1983

[30] Foreign Application Priority Data

Aug. 26, 1982 [JP] Japan ..... 57-148106

[51] Int. Cl.[4] ..... F01L 1/24

[52] U.S. Cl. ..... 123/90.46; 123/90.55; 137/533.13

[58] Field of Search ..... 123/90.46, 90.55, 90.56, 123/90.57, 90.58; 137/533.11, 533.13, 533.19; 24/115 G, 115 M, 132 WL, 136 L; 180/67; 175/422

[56] References Cited

U.S. PATENT DOCUMENTS

| | | | |
|---|---|---|---|
| 1,508,661 | 7/1924 | Lignoski | 175/422 |
| 3,014,472 | 12/1961 | Wisman | 123/90.55 |
| 4,530,319 | 7/1985 | Honda | 123/90.46 |

FOREIGN PATENT DOCUMENTS

| | | | |
|---|---|---|---|
| 32019 | 4/1981 | Japan | 123/90.46 |
| 442203 | 1/1936 | United Kingdom | 175/422 |
| 1190518 | 6/1970 | United Kingdom | 175/422 |

*Primary Examiner*—William R. Cline
*Assistant Examiner*—Peggy A. Neils
*Attorney, Agent, or Firm*—Armstrong, Nikaido, Marmelstein & Kubovcik

[57] ABSTRACT

Disclosed is an improved hydraulic lash adjustor in a valve operating mechanism for automatically eliminating valve head clearance of the type which includes a cylinder, a plunger slidably fitted into the cylinder and a check valve accommodated in a valve cage secured to the bottom portion of the plunger, said check valve being adapted to control communication between a hydraulic chamber defined below the plunger and a hydraulic oil reservoir chamber formed in the plunger in dependence on operation of an engine. A flange portion of the valve cage is firmly held in position between the bottom portion of the plunger and a caulking ring fitted into an annular engagement groove formed on the plunger. The annular engagement groove has upper and lower side wall surfaces and at least the lower side wall surface is formed as a tapered face which extends radially inward at a downward inclination angle.

5 Claims, 6 Drawing Figures

HYDRAULIC LASH ADJUSTOR IN A VALVE OPERATING MECHANISM

BACKGROUND OF THE INVENTION

The present invention relates to a hydraulic valve head clearance eliminating device, that is called a hydraulic lash adjustor, in a valve operating mechanism for automatically eliminating valve head clearance in the latter with the aid of resilient force of a resilient member and hydraulic force and more particularly to an improved hydraulic lash adjustor which is capable of actuating the valve operating mechanism reliably and quietly for a long period of time and which has an excellently high durability.

There has been heretofore proposed a hydraulic lash adjustor of the above-mentioned type as illustrated in FIGS. 1 and 2. This construction is the subject of U.S. patent application Ser. No. 519,537 filed Aug. 1, 1983, now U.S. Pat. No. 4,530,319.

To facilitate understanding of the invention, the heretofore proposed device will first be described with reference to FIGS. 1 and 2.

As will be apparent from the drawings, a cylinder 1 serving as a housing for the hydraulic lash adjustor is constructed in a bottomed cylindrical configuration having an upper open end 1*a* and a closed lower end wall 1*b*, the cylinder 1 being firmly accommodated in a support hole Ea on an engine proper E. A plunger 2 having a semispherical end portion 2*a* at its upper end is slidably fitted into the cylinder 1, said semispherical end portion 2*a* projecting upwardly of the open end 1*a* of the cylinder 1. Further, the plunger 2 has a hydraulic oil reservoir chamber 4 formed therein and a bottom portion 5 at the lower end part while a cylindrical portion 11 is projected downwardly of the bottom portion 5 in a coaxial relation with respect to the plunger 2. On the inner wall surface of the cylindrical portion 11 is formed an annular engagement groove 14 having a rectangular cross-sectional configuration. The annular engagement groove 14 is located at a position spaced from the bottom portion 5 by a distance equal to or appreciably shorter than the thickness of flange portion 12*b* of a valve cage 12 which will be described later. A hydraulic chamber 3 is defined between the bottom portion 5 of the plunger 2 and the end wall 1*b* of the cylinder 1 and it is communicated with the hydraulic oil reservoir chamber 4 via a valve bore 5' formed through the bottom portion 5. The hydraulic oil reservoir chamber 4 is in communication with a hydraulic oil supply passage 10 via a through hole 6 on the side wall of the plunger 2, an annular hydraulic oil passage 7 between the sliding surfaces of the cylinder 1 and the plunger 2, a through hole 8 on the side wall of the cylinder 1 and an annular hydraulic oil passage 9 on the outer surface of the cylinder 1 so that the chamber 4 is normally filled with hydraulic oil delivered from the hydraulic oil supply passage 10.

The lower end of the cylindrical portion 11 of the plunger 2 serves as a stopper for limiting backward movement of the plunger 2 by abutting against a shoulder 1*c* formed on the inner side wall of the cylinder 1 at the lower end part thereof.

The valve cage 12 is accommodated in the hydraulic chamber 3. Specifically, the valve cage 12 comprises a cap-shaped main body 12*a* and the afore-mentioned flange portion 12*b* integrally extending radially outward from the peripheral end part of the main body 12*a*.

The main body 12*a* has a through hole 13 formed therein, whereas the flange portion 12*b* is firmly held in position between the bottom portion 5 of the plunger 2 and a caulking ring 20 which is fitted into the annular engagement groove 14 by caulking operation.

A check valve 15 in the form of a ball is floatably accommodated in the valve cage 12 so as to open or close the valve bore 5'. The check valve 15 is adapted to open when hydraulic pressure in the hydraulic chamber 3 decreases and close when it increases and a stopper 16 is provided on the bottom of the valve cage 12 for limiting the working stroke of the check valve 15. Further, a coil spring 17 is accommodated in the hydraulic chamber 3 so as to force the plunger 2 to project upwardly of the cylinder 1.

The semispherical end part 2*a* of the plunger 2 abuts against the righthand end part of a rocker arm R as seen in the drawing to support the same, whereas the lefthand movable end part of the rocker arm R abuts against the valve head of a poppet valve V which serves to open or close an intake or exhaust port 18 of the internal combustion engine. To open or close the poppet valve V, a valve operating cam C is disposed at an intermediate part of the rocker arm R. The poppet valve V is provided with a valve spring S adapted to bias the valve in the closed position. It should be noted that resilient force of the valve spring S is set far stronger than that of the coil spring 17.

Next, operation of the prior art device will be described below.

When the poppet valve V is kept closed, the plunger 2 is raised up under the influence of resilient force of the coil spring 17 so that the righthand end part of the rocker arm R is biased upward until clearance between the lefthand end part of the rocker arm R and the valve head of the poppet valve V disappears. When hydraulic pressure in the hydraulic chamber 3 decreases as the plunger 2 is raised up, the check valve 15 is caused to open whereby hydraulic oil in the hydraulic oil reservoir chamber 4 is fed into the hydraulic chamber 3 through the valve bore 5' until the hydraulic chamber 3 is filled with hydraulic oil.

Next, when the cam face on the valve operating cam C comes in contact with the rocker arm R as it rotates, the intermediate part of the rocker arm R is depressed downward and valve opening force is developed so that hydraulic pressure appears in the hydraulic chamber 3 which has been kept closed by the check valve 15. Since the plunger 2 is held in the raised state under the influence of the thus developed hydraulic force, the rocker arm R is caused to turn about the semispherical end part 2*a* of the plunger 2 in the anticlockwise direction whereby the poppet valve V is opened against resilient force of the valve spring S. During the operation of the poppet valve V in that way an appreciable amount of hydraulic oil leakes from the hydraulic chamber 3 through close clearance between the sliding surfaces of the cylinder 1 and the plunger 2, but the leaked amount of hydraulic oil will be compensated by an auxiliary supply from the hydraulic oil reservoir chamber 4 during next closing operation of the poppet valve V.

Description will now be made as to how the valve cage 12 is firmly secured to the bottom portion 5 of the plunger 2. As schematically illustrated in FIG. 2, the flange portion 12*b* of the valve cage 12 is first brought in abutment against the lower surface of the bottom portion 5 of the plunger 2, the caulking ring 20 is then brought in abutment against the lower surface of the flange portion 12*b* and thereafter the caulking ring 20 is fitted into the annular engagement groove 14 by caulking operation with the aid of a caulking punch or the like tool. As a result the flange portion 12*b* of the valve cage 12 is firmly held in position between the bottom portion 5 and the caulking ring 20.

To assure that the caulking ring 20 is fitted into the annular engagement groove 14 with an intensity of locking force above a predetermined level, the caulking ring 20 is formed such that its lower surface is located below the lower side wall surface 14*a* of the annular engagement groove 14 by a distance H as shown in FIG. 2 prior to caulking into the groove 14. This distance H which represents an amount of overlapping between the caulking ring 20 and the annular engagement groove 14 varies within a certain range due to machining error and other factors.

When caulking operation is carried out at an insufficient caulking load with a large amount of overlapping H, there may be a case where the caulking ring 20 is subjected to plastic deformation while a part thereof is cut off by the corner edge of the lower side wall surface 14*a* of the annular engagement groove 14 because the surface 14*a* extends at right angles to the axis of the plunger 2. In this case, the caulking ring 20 tends to come in line contact or point contact with the lower side wall surface 14*a* of the annular engagement groove 14. This leads to an occurance of stress concentration on the contact area during operation.

On the other hand, when caulking operation is carried out at an insufficient caulking load with a small amount of overlapping H (with −H in an extreme case), a clearance may appear after mounting between the lower surface of the caulking ring 20 and the lower side wall surface 14*a* of the annular engagement groove 14 due to the rectangular cross-sectional configuration of the groove 14, which will cause the valve cage 12 to move up and down undesirably.

It should be noted that in either of both the above-mentioned cases the caulking ring 20 can be tightly fitted into the annular engagement groove 14 if caulking operation is carried out at a sufficiently high magnitude of caulking load. However, in that case, careful attention should be paid so that the flange portion 12*b* is held at a position between the bottom portion 5 of the plunger 2 and the caulking ring 20 during caulking operation and moreover, care should be taken so as not to damage or injure the valve cage 12 and the plunger 2 particularly in case of a small type hydraulic lash adjustor in which the cylindrical portion 11 of the plunger 2 has a very thin thickness at the position where the annular engagement groove 14 is formed.

SUMMARY OF THE INVENTION

The present invention has been made with the foregoing background in mind and its object resides in providing an improved hydraulic lash adjustor wherein a caulking ring can be smoothly fitted into the annular engagement groove by carrying out caulking operation at a predetermined magnitude of caulking load without any fear of causing a clearance therebetween irrespective of how large an amount of overlapping prior to caulking operation is, thus realizing an improved durability and deleting the possibilities of unnecessary displacement of the valve cage.

To accomplish the above object there is proposed in accordance with the present invention an improved hydraulic lash adjustor in a valve operating mechanism of the type including a cylinder, a plunger slidably fitted into the cylinder, a hydraulic chamber defined between both the cylinder and the plunger, a hydraulic oil reservoir chamber formed in the plunger, said hydraulic oil reservoir chamber being communicated with the hydraulic chamber by way of a valve bore which is formed through a bottom portion provided on the plunger at a lower side thereof, a check valve mounted on the valve bore so as to open when hydraulic pressure in the hydraulic chamber decreases and close when it increases, a valve cage secured to the plunger to accommodate therein the check valve, a cylindrical portion extending downwardly from the bottom portion of the plunger, an annular engagement groove formed around the inner peripheral surface of the cylindrical portion, and a resilient member adapted to bias the plunger so as to project outwardly of the cylinder, wherein said valve cage comprises a cap-shaped main body and a flange portion integrally extending radially outward from the peripheral end part of the main body, said flange portion being firmly held in place between the bottom portion of the plunger and a caulking ring fitted into the annular engagement groove, the improvement consisting in that at least lower side wall surface of the annular engagement groove is designed in the form of a tapered face extending radially inward.

Since the hydraulic lash adjustor according to the invention is constructed such that at least the lower side wall surface of the annular engagement groove formed around the inner surface of the cylindrical portion of the plunger is designed in the form of a tapered face extending radially in such a manner that the open width of the annular engagement groove is enlarged toward the axis of the plunger, it is assured that a caulking ring is smoothly fitted into the annular engagement groove by carrying out caulking operation at a predetermined magnitude of caulking load without producing a clearance therebetween irrespective of how large an amount of overlapping prior to caulking operation is. Thus, caulking of the caulking ring into the annular engagement groove can be reliably performed. As a result, the hydraulic lash adjustor of the invention has an increased durability and does not suffer from such a disadvantage that the valve cage displaces undesirably in its mounted state.

Above and other objects, features and advantages of the invention will be more clearly apparent from reading of the following detailed description of preferred embodiments which has been made in conjunction with FIGS. 3 to 6.

BRIEF DESCRIPTION OF THE DRAWINGS

The accompanying drawings will be briefly described below.

FIGS. 1 and 2 schematically illustrate a hydraulic lash adjustor of the type which has been proposed prior to the present invention, wherein FIG. 1 is a vertical sectional view of the hydraulic lash adjustor and FIG. 2 is an enlarged vertical sectional view of a part of the hydraulic lash adjustor as indicated by circle X in FIG. 1, particularly illustrating a state of a caulking ring prior to its caulking into an annular engagement groove.

FIGS. 3 to 5 schematically illustrate a hydraulic lash adjustor in accordance with a first embodiment of the invention, wherein FIG. 3 is a vertical sectional view of an essential part of the hydraulic lash adjustor illustrating that the caulking ring is normally fitted into the annular engagement groove, FIG. 4 is a vertical sectional view similar to FIG. 3 but showing that the caulking ring is fitted into the annular engagement groove with a large amount of overlapping having been previously provided, and FIG. 5 is a vertical sectional view similar to FIG. 3 but showing that the caulking ring is fitted into the annular engagement groove with a small amount of overlapping having been previously provided, and FIG. 6 schematically illustrates a hydraulic lash adjustor in accordance with a second embodiment of the invention, showing its essential part.

DETAILED DESCRIPTION OF PREFERRED EMBODIMENTS

Figure 1:
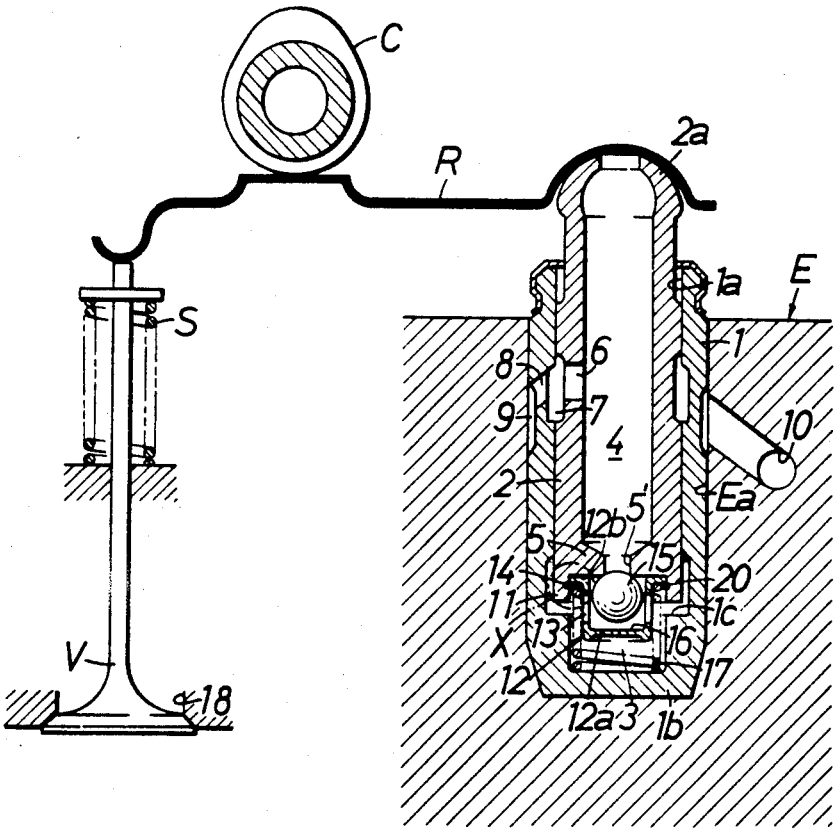
Figure 2:
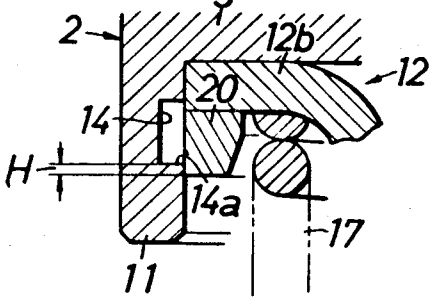

Now, the present invention will be described in a greater detail hereunder with reference to FIGS. 3 to 6. It should be noted that the same or similar parts and components to those of the prior art device as illustrated in FIGS. 1 and 2 are identified with the same reference numerals and characters and their repeated description will be omitted.

Figure 3:
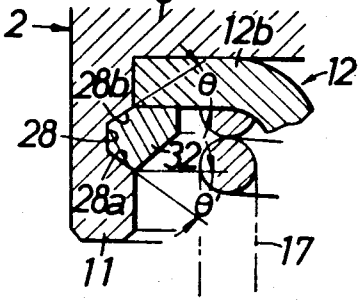
Figure 4:
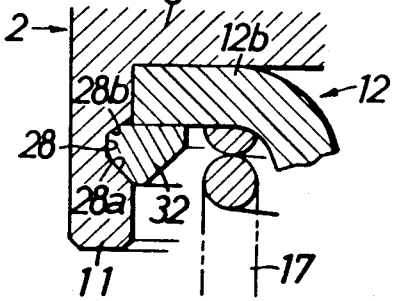
Figure 5:
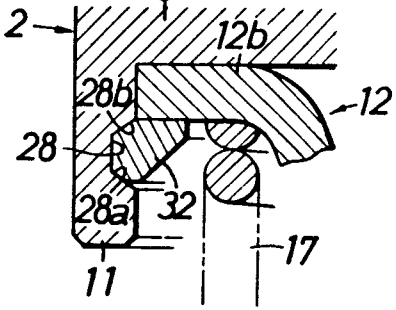

FIGS. 3 to 5 each shows an essential part of a hydraulic lash adjustor in accordance with the first embodiment of the present invention. In this embodiment, an annular engagement groove 28 formed on the inner peripheral surface of the cylindrical portion 11 of the plunger 2 includes upper and lower side wall surfaces 28*a* and 28*b* which extend inward in the radial direction at certain inclination angles, respectively, such that the open width of the annular engagement groove increases toward the axis of the plunger 2. Specifically, the upper side wall surface 28*a* extends inward at an upward inclination angle of $\theta$ with respect to the plane extending at right angles to the axis of the plunger 2, whereas the lower side wall surface 28*b* does at a downward inclination angle of $\theta'$ with respect to the same plane. Both the inclinations angles $\theta$ and $\theta'$ are determined in the range of 15 to 45 degrees, respectively.

As is apparent from the drawings, the lower side wall surface 28*b* constituting the annular engagement groove 28 is designed in the form of a downward tapered face of which inclination angle is selectively determined in the range of 15 to 45 degrees relative to the plane extending vertical to the axis of the plunger 2 in consideration of the direction of application of caulking load. Owing to this arrangement, a caulking ring 32 is subjected to smooth plastic deformation along the inclined side surface 28*b* during caulking operation even if the amount of overlapping H of the ring 32 with respect to the annular engagement groove 28 is large, whereby the caulking ring 28 can be brought in surface contact with the inclined side wall surface 28*a* as illustrated in FIG. 4. As a result, no fear arises of reducing durability of the hydraulic lash adjustor. On the other hand, when the amount of overlapping H is small, the caulking ring 28 is necessarily placed in contact at least with the bottom side part of the inclined side wall surface 28*a*, as illustrated in FIG. 5, so that any downward displacement of the caulking ring 32 within the groove 28 can be reliably prevented. As a result, the flange portion 12*b* can be firmly held by means of the caulking ring 32. Accordingly, the caulking ring 32 can be reliably fitted into the annular engagement groove 28 by caulking operation even in cases where the amount of overlapping H is somewhat too small or too large.

Further, in this embodiment, since the upper side wall surface 28*b* of the annular engagement groove 28 is inclined radially inward at an upward inclination angle, there is no area left in the groove 28 for the caulking ring 32 to escape into. In consequence the caulking ring 32 can be more reliably fitted into the annular engagement groove 28 by caulking operation. Another advantageous feature of this embodiment is that a lathing bit for machining the annular engagement groove 28 is designed in conformance with the cross-sectional shape of the annular engagement groove 28, which enables the lathing bit to have a trapezoidal configuration with a tapered tip end, prolonging its service life.

In the foregoing embodiment, the inclination angles of both the upper and lower side wall surfaces constituting the annular engagement groove 28 are selectively determined in the range of 15 to 45 degrees, respectively, but it has been confirmed that the aforesaid inclination angles may be enlarged to the maximum amount of 60 degrees without any loss of the advantageous features of the invention.

Figure 6:
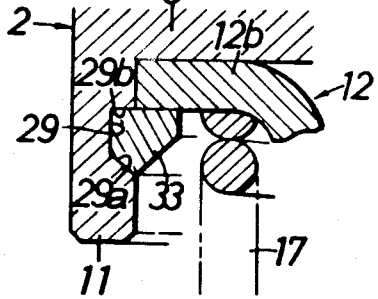

FIG. 6 shows a hydraulic lash adjustor in accordance with the second embodiment of the invention. In this embodiment, an annular engagement groove 29 is formed on the inner peripheral surface of the cylindrical portion 11 of the plunger 2 at a position spaced away from the bottom portion 5 by a distance equal to or shorter than the thickness of the flange portion 12*b* of the valve cage 12. As will be apparent from the drawing, the annular engagement groove 29 includes a tapered face only at the lower side surface thereof, which is identified with reference numeral 29*a* and its upper side wall surface 29*b* is formed to extend horizontally, or at right angles to the axis of the plunger 2. Also in this embodiment the caulking ring 33 can be smoothly fitted into the annular engagement groove 29 without fail while performing plastic deformation along the lower inclined side wall surface 29*a*. Thus, regardless of some fluctuation in the amount of overlapping H, the caulking ring 33 can be reliably fixed in the annular groove 29 thereby to firmly hold the flange portion 12*b* of the valve cage 12 in place. It should be noted that the inclination angle of the lower inclined side wall surface 29*a* is selectively determined in the range of 15 to 45 degrees.

While the present invention has been described above with respect to a few preferred embodiments, it should be of cource understood that it should not be limited only to them but various changes or modifications may be made in a suitable manner without any departure from the spirit and scope of the invention as hereinafter claimed.

What is claimed is:

1. In an improved hydraulic lash adjustor in a valve operating mechanism of the type including a cylinder, a plunger slidably fitted into said cylinder, a hydraulic chamber defined between both the cylinder and the plunger, a hydraulic oil reservoir chamber formed in the plunger, said hydraulic oil reservoir chamber being communicated with the hydraulic chamber by way of a valve bore which is formed through a bottom portion provided on a lower side of said plunger, a check valve mounted on said valve bore so as to open when hydraulic pressure in the hydraulic chamber decreases and close when it increases, a valve cage secured to the plunger to accommodate therein said check valve, a cylindrical portion extending downwardly from the bottom portion of said plunger, an annular engagement groove formed around the inner peripheral surface of said cylindrical portion, and a resilient member adapted to bias said plunger so as to project outwardly of the cylinder, wherein said valve cage comprises a cap-shaped main body and a flange portion integrally extending radially outward from the peripheral end part of said main body, said flange portion being firmly held in place between the bottom portion, of the plunger, and a caulking ring fitted into said annular engagement groove, the improvement wherein a lower side wall surface of the annular engagement groove is formed as a tapered face descending radially inwardly.

2. A hydraulic lash adjustor in a valve operating mechanism as defined in claim 1, wherein said annular engagement groove has an upper side wall surface designed in the form of a tapered face rising radially inwardly.

3. A hydraulic lash adjustor in a valve operating mechanism as defined in claim 1 or 2, wherein said tapered face is inclined with respect to the plane extending at right angles to the axis of the plunger in the range of 15 to 45 degrees.

4. A hydraulic lash adjustor in a valve operating mechanism as defined in claim 2, wherein said tapered faces are inclined with respect to the plane extending at right angles to the axis of the plunger in the range of 15 to 60 degrees.

5. A hydraulic lash adjustor in a valve operating mechanism as defined in claim 1, wherein said annular engagement groove is spaced away from said bottom portion of the plunger by a distance equal to or shorter than the thickness of the flange portion of the valve cage.

* * * * *

UNITED STATES PATENT AND TRADEMARK OFFICE

CERTIFICATE OF CORRECTION

PATENT NO. : 4,621,598

DATED : November 11, 1986

INVENTOR(S) : Seishi Miura

It is certified that error appears in the above-identified patent and that said Letters Patent is hereby corrected as shown below:

On the cover page, Item 73, after "KABUSHIKI" insert ---KAISHA---.

Signed and Sealed this

Twenty-seventh Day of October, 1987

*Attest:*

DONALD J. QUIGG

*Attesting Officer*

*Commissioner of Patents and Trademarks*